US010480168B1

(12) United States Patent
Cox

(10) Patent No.: US 10,480,168 B1
(45) Date of Patent: Nov. 19, 2019

(54) AUTOMATED TOILET

(71) Applicant: Frank Cox, Lubbock, TX (US)

(72) Inventor: Frank Cox, Lubbock, TX (US)

( * ) Notice: Subject to any disclaimer, the term of this patent is extended or adjusted under 35 U.S.C. 154(b) by 0 days.

(21) Appl. No.: 16/037,029

(22) Filed: Jul. 17, 2018

(51) Int. Cl.

| | |
|---|---|
| ***E03D 5/10*** | (2006.01) |
| ***E03D 9/05*** | (2006.01) |
| ***E03D 9/10*** | (2006.01) |
| ***E03D 5/02*** | (2006.01) |
| *E03D 1/14* | (2006.01) |

(52) U.S. Cl.
CPC ..... *E03D 5/105* (2013.01); *E03D 5/022* (2013.01); *E03D 9/05* (2013.01); *E03D 1/14* (2013.01)

(58) Field of Classification Search
CPC .. E03D 5/01; E03D 5/105; E03D 9/05; E03D 9/052; E03D 9/10
USPC ..... 4/319–320, 431
See application file for complete search history.

(56) References Cited

U.S. PATENT DOCUMENTS

| | | | | |
|---|---|---|---|---|
| 5,539,938 | A | 7/1996 | Tubbs | |
| D480,790 | S | 10/2003 | Lebrun, Sr. | |
| 8,490,221 | B1 * | 7/2013 | Conde | E03D 5/09 4/213 |
| 8,973,174 | B2 | 3/2015 | Palazzola | |
| 9,133,611 | B2 | 9/2015 | Plugovoy | |
| 2005/0028255 | A1 | 2/2005 | Ma | |
| 2010/0257668 | A1 | 10/2010 | White | |
| 2016/0040415 | A1 * | 2/2016 | Wafford | E03D 9/052 4/213 |
| 2017/0254060 | A1 | 9/2017 | Hall | |

* cited by examiner

*Primary Examiner* — Janie M Loeppke
(74) *Attorney, Agent, or Firm* — Kyle A. Fletcher, Esq.

(57) ABSTRACT

The automated toilet comprises a toilet with a motorized pump in line with the drain pipe, a sensor, a control box, and a flush valve actuator. The sensor detects the presence of a user in front of the toilet and notifies the control box. When a user arrives, the control box starts the pump to draw air through the rim and into the sewer line, which removes odors while the toilet is being used. When the user leaves, the control box activates the flush valve actuator, causing the toilet to flush. The control box may run the pump for a predetermined time interval so that the pump may assist in emptying the bowl. When the bowl has emptied, the pump may continue to draw odors from the bowl until the control box shuts the pump off.

17 Claims, 4 Drawing Sheets

AUTOMATED TOILET

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of bathroom fixtures, more specifically, an automated toilet.

SUMMARY OF INVENTION

The automated toilet comprises a toilet with a motorized pump in line with the drain pipe, a sensor, a control box, and a flush valve actuator. The sensor detects the presence of a user in front of the toilet and notifies the control box. When a user arrives, the control box starts the pump to draw air through the rim and into the sewer line, which removes odors while the toilet is being used. When the user leaves, the control box activates the flush valve actuator, causing the toilet to flush. The control box may run the pump for a predetermined time interval so that the pump may assist in emptying the bowl. When the bowl has emptied, the pump may continue to draw odors from the bowl until the control box shuts the pump off.

An object of the invention is to provide a motorized pump in line with the drain pipe of a toilet.

Another object of the invention is to sense a user in front of a toilet using a motion of presence sensor.

A further object of the invention is to run a pump to remove odors though the rim of the toilet while a user is present.

Yet another object of the invention is to activate a flush valve actuator when the user leaves to flush the toilet.

These together with additional objects, features and advantages of the automated toilet will be readily apparent to those of ordinary skill in the art upon reading the following detailed description of the presently preferred, but nonetheless illustrative, embodiments when taken in conjunction with the accompanying drawings.

In this respect, before explaining the current embodiments of the automated toilet in detail, it is to be understood that the automated toilet is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the automated toilet.

It is therefore important that the claims be regarded as including such equivalent construction insofar as they do not depart from the spirit and scope of the automated toilet. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description. As used herein, the word "or" is intended to be inclusive.

Figure 1:
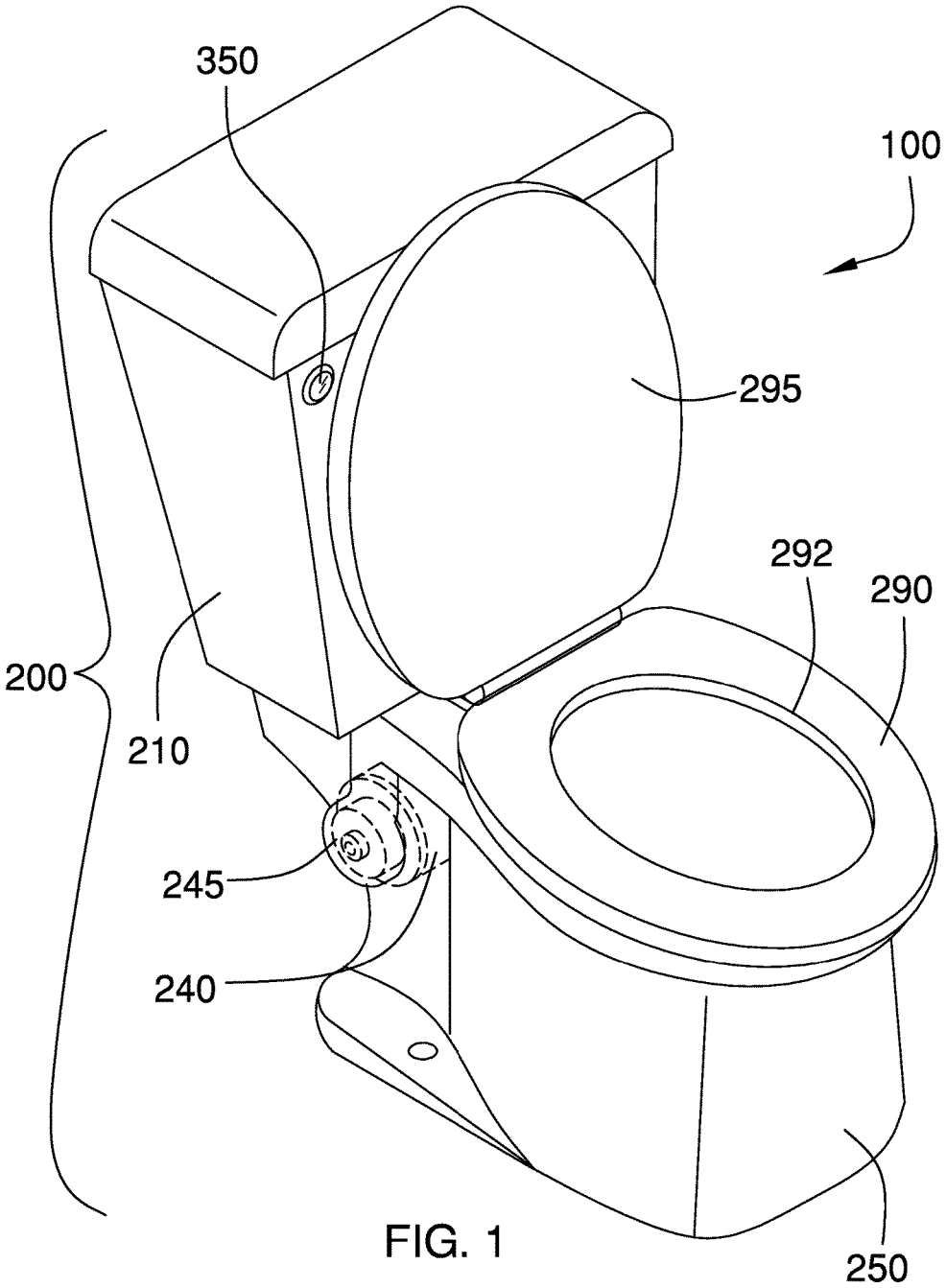
FIG. 1 is a perspective view of an embodiment of the disclosure.
Figure 2:
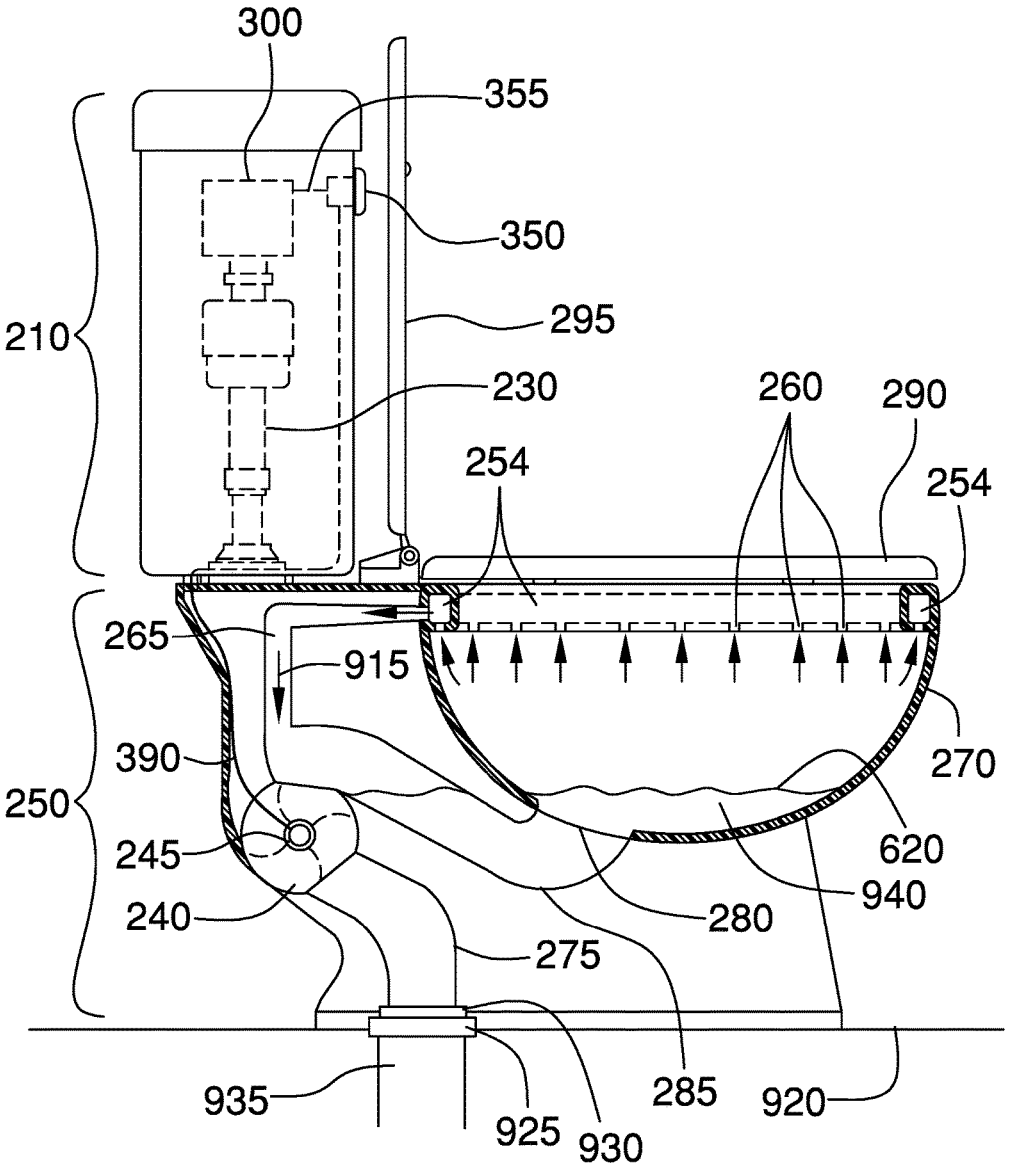
FIG. 2 is a cut-away side view of an embodiment of the disclosure illustrating air paths through the rim and air channel.
Figure 3:
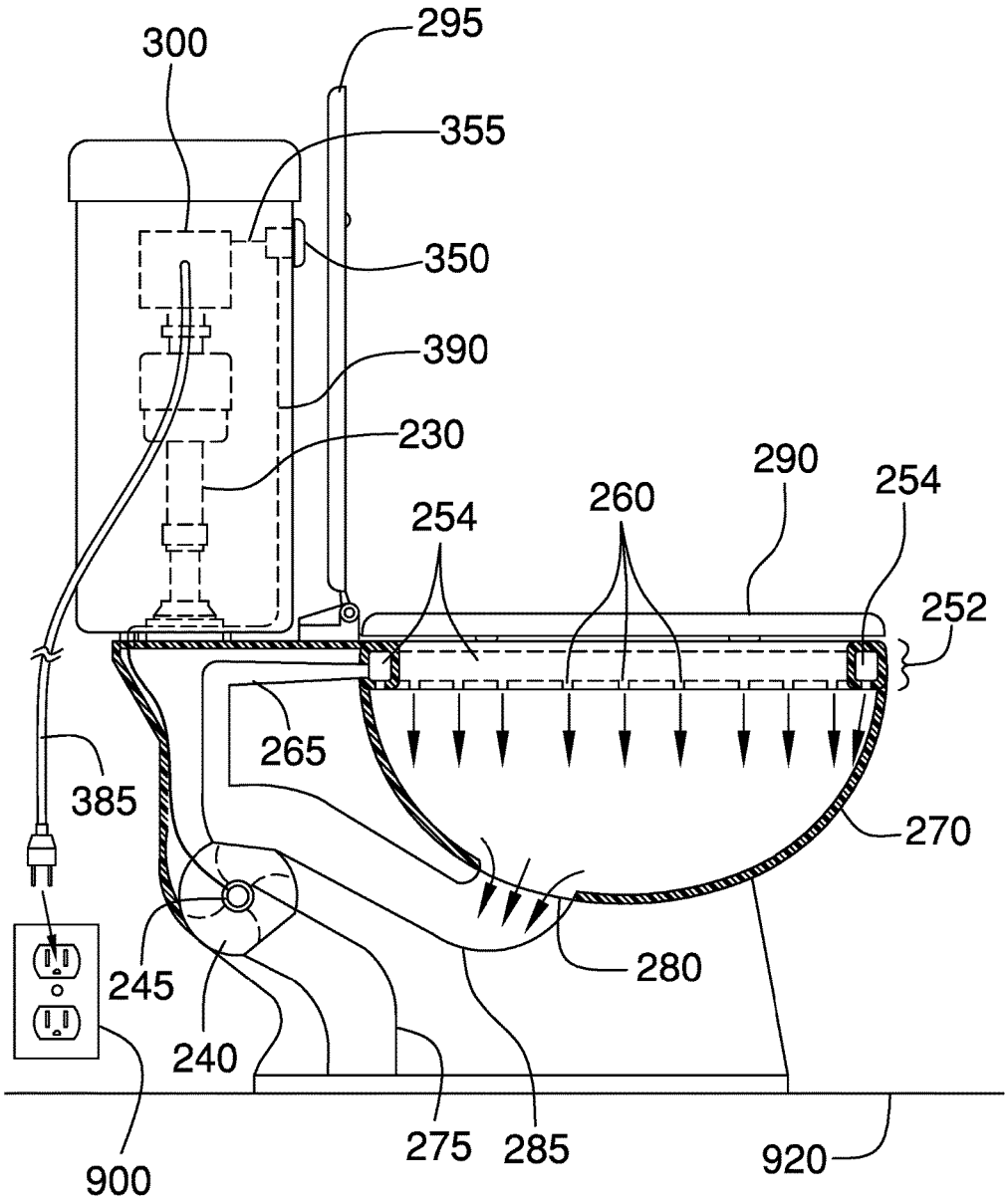
FIG. 3 is a cut-away side view of an embodiment of the disclosure illustrating the flow of water through the rim and drain pipe.
Figure 4:
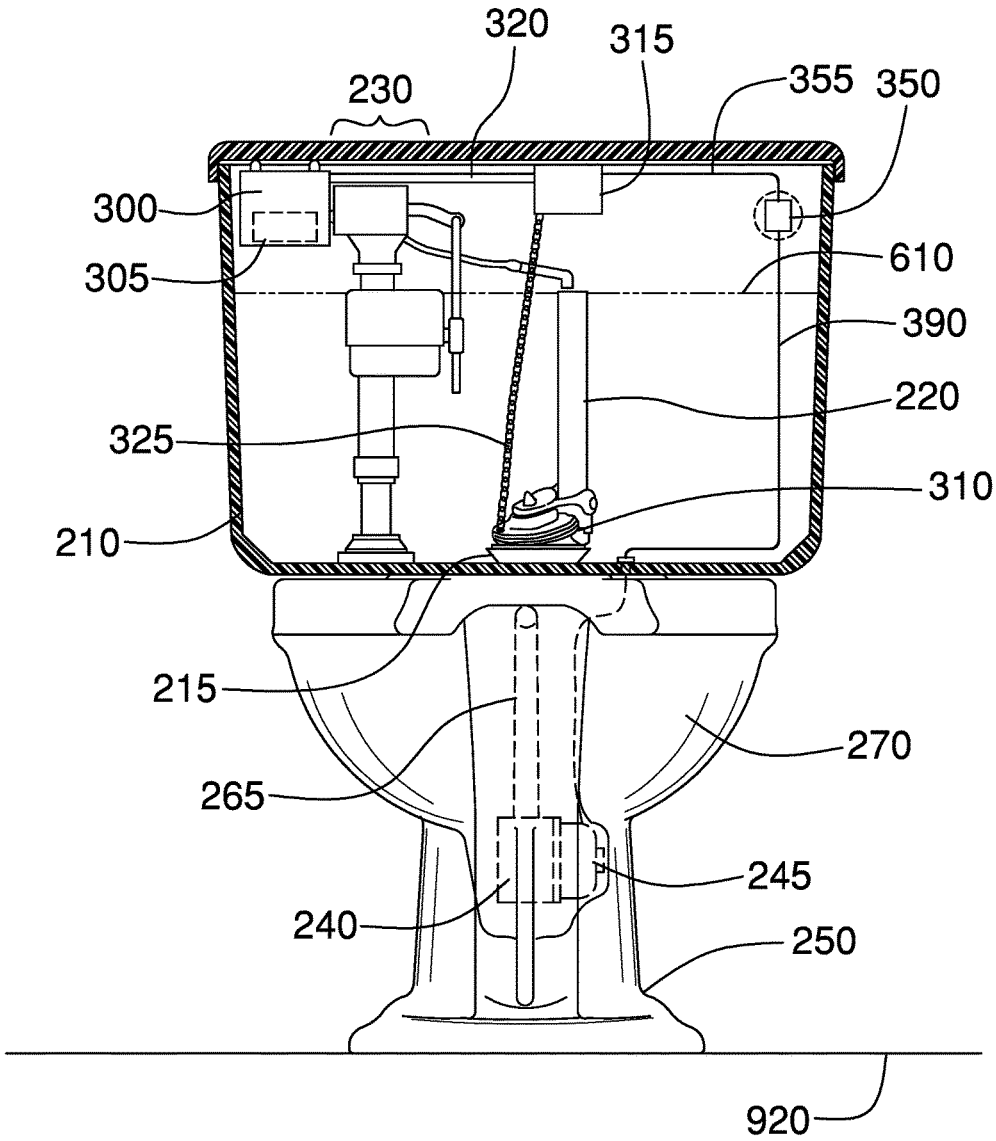
FIG. 4 is a cut-away rear view of an embodiment of the disclosure.

Detailed reference will now be made to a first potential embodiment of the disclosure, which is illustrated in FIGS. 1 through 4.

The automated toilet 100 (hereinafter invention) comprises a pump 240, a motor 245, a sensor 350, a control box 300, a flush valve actuator 315, and a toilet 200. The sensor 350 may be adapted to detect the presence of a user in front of the toilet 200. The sensor 350 may be adapted to signal the control box 300 to start the motor 245, thus utilizing the pump 240 to remove odors from a bowl 270 of the toilet 200, upon detecting that the user has arrived in front of the toilet 200. The sensor 350 may be adapted to signal the control box 300 to activate a flush valve 310, via the flush valve actuator 315, upon detecting that the user has moved away from the toilet 200.

The pump 240 may move air 915 and/or toilet waste mechanically. As a non-limiting example, the pump 240 may be a positive displacement pump. The pump 240 may draw the air 915 from the bowl 270 when the pump 240 is operating and the bowl 270 is not draining. The pump 240 may pass the air 915 into a sewer line 935. The pump 240 may be located in a drain pipe 275 downstream from a trap 285. The pump 240 may draw the toilet waste from the bowl 270 when the pump 240 is operating and the bowl 270 is draining. The pump 240 may pass the toilet waste into the sewer line 935.

The motor 245 may be located along side of the pump 240 and may be coupled to the pump 240. The motor 245 may cause the pump 240 to rotate when an electrical potential is applied to the motor 245. The motor 245 may receive the electrical potential from the control box 300 via motor wiring 390.

The sensor 350 may be adapted to detect the presence or motion of the user in front of the toilet 200. As non-limiting examples, the sensor 350 may use passive or active infrared technology, ultrasonic technology, capacitive technology, RF proximity technology, or a combination thereof to detect the user. The sensor 350 may signal the control box 300 via a sensor signal 355 to indicate the presence or absence of the user.

The control box 300 may control the overall operation of the invention 100. The control box 300 may be located within a tank 210 and above a maximum tank water level 610. The control box 300 may be packaged in a waterproof enclosure. As non-limiting examples:

The control box 300 may be adapted to activate the motor 245 when the sensor 350 indicates that the user has arrived in front to the toilet 200. The motor 245 may cause the pump 240 to draw the air 915 through a plurality of rim apertures 260, through a rim channel 254 located within a rim 252, through an air channel 265, and into the drain pipe 275. The air 915 may be forced through the pump 240 and into the sewer line 935.

The control box 300 may be adapted to activate the flush valve actuator 315 when the sensor 350 indicates that the user is no longer in front to the toilet 200. The flush valve actuator 315 may pull the flush valve 310 open and allow water 940 from the tank 210 to flow into the bowl 270 via the rim channel 254 and the plurality of rim apertures 260. The flush valve 310 may close itself when all of the water 940 has flowed out of the tank 210. The flow of the water 940 into the bowl 270 may raise a bowl water level 620 until the water 940 begins to flow past the trap 285 and into the pump 240, which may still be running. Once the water 940 is flowing through the trap 285, the bowl water level 620 may begin to fall and suction created by the toilet waste flowing through the drain pipe 275 may pull the toilet waste out of the bowl 270 and into the pump 240. The pump 240 may break solids into pieces and may force the toilet waste into the sewer line 935. Once the bowl 270 has emptied and suction is lost, the water 940 flowing into the bowl 270 from the rim 252 may begin to refill the bowl 270 and the trap 285 in preparation for the next use of the toilet 200.

The control box 300 may continue to run the motor 245 for a predetermined time interval to assure that the toilet waste passes into the sewer line 935 and to remove odors lingering in the bowl 270. At the expiration of the predetermined time interval, the control box 300 may deactivate the motor 245 and thereby stop the pump 240.

The control box 300 may be powered from a power cord 385 that plugs into an electrical outlet 900.

The flush valve actuator 315 may cause the flush valve 310 to open when activated by a flush signal 320 originating at the control box 300. The flush valve actuator 315 may be located within the tank 210 directly above the flush valve 310. The flush valve actuator 315 may electromechanically pull on a chain 325 leading to the flush valve 310 when triggered by the flush signal 320. The flush valve actuator 315 may then release the chain 325 and allow the flush valve 310 to close on its own.

The toilet 200 comprises the tank 210, a base 250, a seat 290, and a lid 295. The drain pipe 275 within the base 250 may route the toilet waste from a drain aperture 280 located at the bottom of the bowl 270 to a closet flange 925 on a floor 920 where the toilet waste may pass through a wax ring 930 and on to the sewer line 935. The drain pipe 275 may bend in an 'S' shape, forming the trap 285 to hold the water 940 as an odor barrier.

The tank 210 may hold the water 940 that is used to flush the bowl 270. The tank 210 comprises a fill valve 230 and the flush valve 310. The tank 210 may be coupled to the top rear of the base 250. The water 940 may fill the tank 210 from the fill valve 230 and may flow out of the tank 210 through the flush valve 310. The tank 210 may comprise an overflow pipe 220 which projects upwards from the bottom of the tank 210. The overflow pipe 220 may prevent the tank 210 from overfilling if the fill valve 230 fails to shut off by diverting the water 940 that rises above the maximum tank water level 610 into the rim channel 254 from which it may reach the bowl 270. The tank 210 may comprise a tank aperture 215 which may be an opening at the bottom center of the tank 210 that leads to the rim channel 254. The tank aperture 215 may be used to fill the bowl 270 with the water 940 from the tank 210 via the rim channel 254.

The fill valve 230 may sense when the tank 210 has been emptied and may allow the water 940 to flow into the tank 210. The fill valve 230 may sense when the water 940 has reached the maximum tank water level 610 at which point the fill valve 230 may stop the flow of the water 940 into the tank 210. The fill valve 230 may be supplied with the water 940 from a water supply line that couples to the bottom of the fill valve 230 on the underside of the tank 210.

The flush valve 310 may be a flap hinged to the bottom of the tank 210 or to the bottom of the overflow pipe 220 adjacent to the tank aperture 215. The chain 325 may be coupled to the flush valve 310 to pull the flush valve 310 open. The flush valve 310 may create a watertight seal with the tank aperture 215 to prevent the water 940 from leaving the tank 210. The flush valve 310 may be held closed by the weight of the water 940 above the flush valve 310. The flush valve 310 may open when the chain 325 is pulled, breaking the watertight seal. The flush valve 310 may stay open due to buoyancy provided by the air 915 in a cavity on the underside of the flush valve 310. When the tank 210 has emptied, the flush valve 310 may fall against the tank aperture 215 and seal again as the water 940 fills the tank 210 above it.

The base 250 comprises the bowl 270 and the drain pipe 275. The base 250 may comprise the bottom of the toilet 200. The front of the base 250 may form the bowl 270. The top rear of the base 250 may provide a coupling point for the tank 210. The base 250 may sit on the floor 920. The base 250 may be bolted or otherwise secured to the floor 920 or to the closet flange 925.

The bowl 270 may be a semispherical container for collecting the toilet waste. The bowl 270 comprises the rim 252 and the drain aperture 280. The rim 252 may surround the top of the bowl 270. The rim 252 may comprise the plurality of rim apertures 260 located on the underside of the rim 252. The plurality of rim apertures 260 may open to the rim channel 254. The rim channel 254 and the plurality of rim apertures 260 may distribute the water 940 from the tank 210 when the flush valve 310 is open. The rim channel 254 and the plurality of rim apertures 260 may pull the air 915 from the bowl 270 when the flush valve 310 is closed and the pump 240 is running.

The drain aperture 280 may be located at the bottom of the bowl 270 and may provide an exit for the toilet waste to leave the bowl 270. The drain aperture 280 may couple to the drain pipe 275. The drain pipe 275 may bend to form the trap 285. The trap 285 may hold the water 940 to prevent odors from the sewer line 935 from reaching the bowl 270. The drain pipe 275 may continue on to couple with the closet flange 925 on the floor 920. The toilet waste passing through the drain pipe 275 may exit into the sewer line 935. The seat 290 may hingedly couple to the top rear of the bowl 270 to provide a seating surface. The seat 290 may comprise a seat aperture 292. The seat 290 may comprise the lid 295 that is hingedly coupled to the rear of the seat 290. The lid 295 may cover the seat aperture 292 when the toilet 200 is not in use.

In some embodiments, the control box 300 may comprise a battery 305. The battery 305 may comprise one or more energy storage devices. The battery 305 may be a source of electrical energy to operate the sensor 350, the flush valve actuator 315, and the pump 240. The battery 305 may be replaceable or rechargeable. As a non-limiting example, the battery 305 may recharge while power is available and may provide the electrical potential to operate the toilet 200 during power outages.

DEFINITIONS

Unless otherwise stated, the words "up", "down", "top", "bottom", "upper", and "lower" should be interpreted within a gravitational framework. "Down" is the direction that gravity would pull an object. "Up" is the opposite of "down". "Bottom" is the part of an object that is down farther than any other part of the object. "Top" is the part of an object that is up farther than any other part of the object. "Upper" refers to top and "lower" refers to the bottom. As a non-limiting example, the upper end of a vertical shaft is the top end of the vertical shaft.

As used in this disclosure, an "aperture" is an opening in a surface. Aperture may be synonymous with hole, slit, crack, gap, slot, or opening.

Throughout this document the terms "battery", "battery pack", and "batteries" may be used interchangeably to refer to one or more wet or dry cells or batteries of cells in which chemical energy is converted into electricity and used as a source of DC power. References to recharging or replacing batteries may refer to recharging or replacing individual cells, individual batteries of cells, or a package of multiple battery cells as is appropriate for any given battery technology that may be used. The battery may require electrical contacts which may not be illustrated in the figures.

As used in this disclosure, a "cavity" is an empty space or negative space that is formed within an object.

As used in this disclosure, a "chain" is a series of interlinked rings that form a cord like structure. Like a cord, a chain has tensile strength but is too flexible to provide compressive strength and is not suitable for use in pushing objects. The rings to form a chain are often formed from a metal.

As used in this disclosure, a "channel" is a tubular passage through which an object or fluid is passed through.

As used herein, the words "couple", "couples", "coupled" or "coupling", refer to connecting, either directly or indirectly, and does not necessarily imply a mechanical connection.

As used in this disclosure, a "flange" is a protruding rib, edge, or collar that is used to hold an object in place or to attach a first object to a second object.

As used in this disclosure, a "flap" is a piece of material that is hinged or otherwise attached to a surface using one side such that the piece of material hangs in such a way as to cover a hole in a surface or to provide a barrier between objects.

As used herein, "front" indicates the side of an object that is closest to a forward direction of travel under normal use of the object or the side or part of an object that normally presents itself to view or that is normally used first. "Rear" or "back" refers to the side that is opposite the front.

As used in this disclosure, a "lid" is a movable or removable cover that is placed on a hollow structure to contain and/or protect the contents within the hollow structure.

As used in this disclosure, a "motor" refers to a device that transforms energy from an external power source into mechanical energy.

As used in this disclosure, an "outlet" is a device placed in the electrical wiring system of a building where electrical current can be taken to run electrical devices. In this disclosure, an outlet is a socket adapted to receive a plug. In some embodiments, an outlet may find use in a vehicle or on equipment. As non-limiting examples, outlets may be used on recreational vehicles and on generators.

As used in this disclosure, a "pipe" is a hollow cylindrical device that is used for transporting liquids and gases or for structural purposes. The line that connects the center of the first base of the cylinder to the center of the second base of the cylinder is referred to as the axis of the cylinder or the centerline of the pipe. When two pipes share the same centerline they are said to be aligned. In this disclosure, the terms inner diameter of a pipe and outer diameter are used as they would be used by those skilled in the plumbing arts.

As used in this disclosure, a "pump" is a mechanical or electromechanical device that uses suction or pressure to raise or move fluids, compress fluids, or force a fluid into an inflatable object. As non-limiting examples, fluids may include both liquids, such as water, and gases, such as air.

As used herein, "positive displacement pump" may refer to a pump that moves a fluid by trapping a fixed amount of fluid on the suction side and forcing (displacing) that trapped volume out of the pump on the discharge side.

As used in this disclosure, a "rim" is an outer edge or border that follows along the perimeter of an object.

As used in this disclosure, a "sensor" is a device that quantitatively measures a physical stimulus.

As used in this disclosure, a "valve" is a device that is used to control the flow of a fluid (gas or liquid) through a pipe or to control the flow of a fluid into and out of a container. Some valves may have multiple ports and may allow the diverting or mixing of fluids.

As used herein, the word "waterproof" refers to an object that is not harmed when being exposed to water, including total submersion for a period of time. When used as a verb, "waterproof" refers to taking steps to make an object waterproof. Non-limiting examples of such steps may include applying special coatings or using gaskets to seal seams and entry points of an enclosure.

As used herein, the word "watertight" refers to a barrier that is impermeable to water.

Throughout this document references to "wire", "wires", "wired", or "wiring" may describe and/or show a single conductor when, in fact, two conductors may be required to power or control a subsystem; a convention used herein is to not show the common return conductor to which all electrical subsystems are connected—this common return conductor is a continuous electrical path and does not pass through any type of switch or other electrical component other than the possibility of passing through one or more connectors.

With respect to the above description, it is to be realized that the optimum dimensional relationship for the various components of the invention described above and in FIGS. 1 through 4, include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. An automated toilet comprising:

a pump, a motor, a sensor, a control box, a flush valve actuator, and a toilet;

wherein the sensor is adapted to detect the presence of a user in front of the toilet;

wherein the sensor is adapted to signal the control box to start the motor, thus utilizing the pump to remove odors from a bowl of the toilet, upon detecting that the user has arrived in front of the toilet;

wherein the sensor is adapted to signal the control box to activate a flush valve, via the flush valve actuator, upon detecting that the user has moved away from the toilet;

wherein the pump moves air and/or toilet waste mechanically;

wherein the pump draws the air from the bowl when the pump is operating and the bowl is not draining;

wherein the pump passes the air into a sewer line;

wherein the pump is located in a drain pipe downstream from a trap;

wherein the pump draws the toilet waste from the bowl when the pump is operating and the bowl is draining;

wherein the pump passes the toilet waste into the sewer line.

2. The automated toilet according to claim 1 wherein the pump is a positive displacement pump.

3. The automated toilet according to claim 1 wherein the motor is located along side of the pump and is coupled to the pump;

wherein the motor causes the pump to rotate when an electrical potential is applied to the motor;

wherein the motor receives the electrical potential from the control box via motor wiring.

4. The automated toilet according to claim 3 wherein the sensor is adapted to detect the presence or motion of the user in front of the toilet;

wherein the sensor signals the control box via a sensor signal to indicate the presence or absence of the user.

5. The automated toilet according to claim 4 wherein the control box controls the overall operation of the automated toilet;

wherein the control box is located within a tank and above a maximum tank water level.

6. The automated toilet according to claim 5 wherein the control box is adapted to activate the motor when the sensor indicates that the user has arrived in front to the toilet;

wherein the motor causes the pump to draw the air through a plurality of rim apertures, through a rim channel located within a rim, through an air channel, and into the drain pipe;

wherein the air is forced through the pump and into the sewer line.

7. The automated toilet according to claim 6 wherein the control box is adapted to activate the flush valve actuator when the sensor indicates that the user is no longer in front to the toilet;

wherein the flush valve actuator pulls the flush valve open and allows water from the tank to flow into the bowl via the rim channel and the plurality of rim apertures;

wherein the flush valve closes itself when all of the water has flowed out of the tank;

wherein the flow of the water into the bowl raises a bowl water level until the water begins to flow past the trap and into the pump;

wherein once the water is flowing through the trap, the bowl water level fall ands suction created by the toilet waste flowing through the drain pipe pulls the toilet waste out of the bowl and into the pump;

wherein the pump breaks solids into pieces and forces the toilet waste into the sewer line;

wherein once the bowl has emptied and suction is lost, the water flowing into the bowl from the rim begin to refill the bowl and the trap in preparation for the next use of the toilet.

8. The automated toilet according to claim 7 wherein the control box continues to run the motor for a predetermined time interval to assure that the toilet waste passes into the sewer line and to remove odors lingering in the bowl;

wherein at the expiration of the predetermined time interval, the control box deactivates the motor and thereby stops the pump.

9. The automated toilet according to claim 8 wherein the flush valve actuator causes the flush valve to open when activated by a flush signal originating at the control box;

wherein the flush valve actuator is located within the tank directly above the flush valve;

wherein the flush valve actuator electromechanically pulls on a chain leading to the flush valve when triggered by the flush signal;

wherein the flush valve actuator releases the chain and allows the flush valve to close on its own.

10. The automated toilet according to claim 9 wherein the toilet comprises the tank, a base, a seat, and a lid;

wherein the drain pipe within the base routes the toilet waste from a drain aperture located at the bottom of the bowl to a closet flange on a floor where the toilet waste passes through a wax ring and on to the sewer line;

wherein the drain pipe bends in an 'S' shape, forming the trap to hold the water as an odor barrier.

11. The automated toilet according to claim 10 wherein the tank holds the water that is used to flush the bowl;

wherein the tank comprises a fill valve and the flush valve;
wherein the tank is coupled to the top rear of the base;
wherein the water fills the tank from the fill valve and flows out of the tank through the flush valve;
wherein the tank comprises an overflow pipe which projects upwards from the bottom of the tank;
wherein the overflow pipe prevents the tank from overfilling if the fill valve fails to shut off by diverting the water that rises above the maximum tank water level into the rim channel from which it reaches the bowl;
wherein the tank comprises a tank aperture which is an opening at the bottom center of the tank that leads to the rim channel;
wherein the tank aperture is used to fill the bowl with the water from the tank via the rim channel.

12. The automated toilet according to claim 11
wherein the fill valve senses when the tank has been emptied and allows the water to flow into the tank;
wherein the fill valve senses when the water has reached the maximum tank water level at which point the fill valve stops the flow of the water into the tank;
wherein the fill valve is supplied with the water from a water supply line that couples to the bottom of the fill valve on the underside of the tank.

13. The automated toilet according to claim 12
wherein the flush valve is a flap hinged to the bottom of the tank or to the bottom of the overflow pipe adjacent to the tank aperture;
wherein the chain is coupled to the flush valve to pull the flush valve open;
wherein the flush valve creates a watertight seal with the tank aperture to prevent the water from leaving the tank;
wherein the flush valve is held closed by the weight of the water above the flush valve;
wherein the flush valve opens when the chain is pulled, breaking the watertight seal;
wherein the flush valve stays open due to buoyancy provided by the air in a cavity on the underside of the flush valve;
wherein when the tank has emptied, the flush valve falls against the tank aperture and seal again as the water fills the tank above it.

14. The automated toilet according to claim 13
wherein the base comprises the bowl and the drain pipe;
wherein the base comprises the bottom of the toilet;
wherein the front of the base forms the bowl;
wherein the top rear of the base provides a coupling point for the tank;
wherein the base sits on the floor;
wherein the base is secured to the floor or to the closet flange.

15. The automated toilet according to claim 14
wherein the bowl is a semispherical container for collecting the toilet waste;
wherein the bowl comprises the rim and the drain aperture;
wherein the rim surrounds the top of the bowl;
wherein the rim comprises the plurality of rim apertures located on the underside of the rim;
wherein the plurality of rim apertures open to the rim channel;
wherein the rim channel and the plurality of rim apertures distribute the water from the tank when the flush valve is open;
wherein the rim channel and the plurality of rim apertures pull the air from the bowl when the flush valve is closed and the pump is running.

16. The automated toilet according to claim 15
wherein the drain aperture is located at the bottom of the bowl and provides an exit for the toilet waste to leave the bowl;
wherein the drain aperture couples to the drain pipe;
wherein the drain pipe bends to form the trap;
wherein the trap holds the water to prevent odors from the sewer line from reaching the bowl;
wherein the drain pipe continues on to couple with the closet flange on the floor;
wherein the toilet waste passing through the drain pipe exits into the sewer line;
wherein the seat hingedly couples to the top rear of the bowl to provide a seating surface;
wherein the seat comprises a seat aperture;
wherein the seat comprises the lid that is hingedly coupled to the rear of the seat;
wherein the lid covers the seat aperture when the toilet is not in use.

17. The automated toilet according to claim 16
wherein the control box comprises a battery;
wherein the battery comprises one or more energy-storage devices;
wherein the battery is a source of electrical energy to operate the sensor, the flush valve actuator, and the pump;
wherein the battery is replaceable or rechargeable.

* * * * *